US010322052B2

(12) United States Patent
Panetta et al.

(10) Patent No.: US 10,322,052 B2
(45) Date of Patent: Jun. 18, 2019

(54) LEFT ARM TRANS ACCESS POSITIONING APPARATUS

(71) Applicants: Carmelo Panetta, Minneapolis, MN (US); Yunxing Liu, North Oaks, MN (US)

(72) Inventors: Carmelo Panetta, Minneapolis, MN (US); Yunxing Liu, North Oaks, MN (US)

(73) Assignee: LP Medical LLP

( * ) Notice: Subject to any disclaimer, the term of this patent is extended or adjusted under 35 U.S.C. 154(b) by 517 days.

(21) Appl. No.: 14/668,372

(22) Filed: Mar. 25, 2015

(65) Prior Publication Data

US 2016/0089295 A1 Mar. 31, 2016

Related U.S. Application Data

(60) Provisional application No. 62/056,062, filed on Sep. 26, 2014.

(51) Int. Cl.
*A61G 13/12* (2006.01)
*A61G 15/12* (2006.01)

(52) U.S. Cl.
CPC ..... *A61G 15/12* (2013.01); *A61G 13/124* (2013.01); *A61G 13/1235* (2013.01)

(58) Field of Classification Search
CPC .. A61F 5/0584; A61F 5/0585; A61F 5/05858; A61F 5/05866; A61F 5/3761; A61G 7/065; A61G 7/075; A61G 7/1082; A61G 7/1092; A61G 7/1094; A61G 13/12; A61G 13/124; A61G 13/122; A61G 13/1235; A61G 13/1245; A61G 15/12; A61M 5/52
(Continued)

(56) References Cited

U.S. PATENT DOCUMENTS 2,782,427 A * 2/1957 Ericson ..... A47G 9/10 5/632
3,256,880 A * 6/1966 Caypinar ..... A61M 5/52 128/877

(Continued)

FOREIGN PATENT DOCUMENTS

WO WO 2004071302 A1 * 8/2004 ..... A61B 6/04

*Primary Examiner* — Keri J Nelson
*Assistant Examiner* — Adam Baker
(74) *Attorney, Agent, or Firm* — Kira Ries

(57) ABSTRACT

In one example, an apparatus for positioning a patient's forearm during a medical procedure has a main panel portion, an extended panel portion and a base panel portion. The main panel portion has an inner surface and an outer surface, a first longitudinal side edge, a second longitudinal side edge, a first latitudinal side edge and a second latitudinal side edge. The extended panel portion has panel portion having a proximal end edge and a distal end edge, and an inner surface, wherein said distal end edge forms an angled configuration with said main panel portion for positioning the patient's left forearm and wrist suitably for receiving an arterial catheter. The base panel portion has a first longitudinal side edge and a second longitudinal side edge, wherein said first longitudinal side edge of said base panel portion extends generally perpendicularly outward from said second longitudinal side edge of said main panel portion.

18 Claims, 7 Drawing Sheets

(58) Field of Classification Search
USPC ..... 128/878, 874, 875, 876, 877, 881, 882, 128/845, 846; 5/600, 613, 630, 621, 623, 5/646, 647, 628
See application file for complete search history.

(56) References Cited

U.S. PATENT DOCUMENTS

| | | | | | |
|---|---|---|---|---|---|
| 3,668,722 | A * | 6/1972 | Gallant | A47C 15/008 | 5/127 |
| 4,270,235 | A * | 6/1981 | Gutmann | A61G 7/075 | 5/646 |
| 5,228,457 | A * | 7/1993 | Kawamura | A61B 46/10 | 128/846 |
| 5,485,856 | A * | 1/1996 | Buckland | A61B 6/0421 | 128/879 |
| 5,546,963 | A * | 8/1996 | Doody | A61F 5/3761 | 128/878 |
| 5,785,057 | A * | 7/1998 | Fischer | A61F 5/3761 | 128/846 |
| 6,003,175 | A * | 12/1999 | Couch | A61G 7/0755 | 378/177 |
| 6,101,650 | A * | 8/2000 | Omdal | A61G 13/1235 | 128/878 |
| 8,286,285 | B2 * | 10/2012 | Mahler | A61F 5/01 | 128/878 |
| 2012/0131751 | A1 * | 5/2012 | Mahler | A61F 5/01 | 5/646 |

* cited by examiner

LEFT ARM TRANS ACCESS POSITIONING APPARATUS

BACKGROUND

In diagnosing and treating heart diseases caused by occlusion of the coronary arteries, a physician may perform various tests and non-surgical procedures in which a catheter is guided through an artery in the arm or leg and into the selected coronary artery of the heart. Once in place, the catheter is then used for performing diagnostic tests such as a coronary angiography in which a radio imaging material is injected to visualize the arteries, or therapeutic interventions such as a coronary angioplasty, stenting, or atherectomy. A physician may insert the catheter in the patient using a femoral, brachial, or transradial coronary intervention approach.

In a transradial approach, the catheter is introduced into the aorta via the radial artery in the wrist. The radial artery and the ulnar artery are two small arteries in the wrist that communicate through the palmar arch. The physician may introduce the catheter via either the right or left radial artery. The physician may choose to access the left radial artery due to accessibility for engaging the left subclavian artery and the left internal mammary artery (LIMA), proximity to the LIMA and subclavian artery, proximity to a subclavian graft, compromised access of the right radial artery, medical conditions of the patient, or other conditions of the patient where accessing the right radial artery is not medically advised. However, a problem with the use of performing this technique on the left radial artery of the patient is that the physician stands on the patient's right side and has to lean over the patient and reach around the patient's abdomen to perform the procedure on the left wrist, causing strain on the physician's lower back and upper body. Another problem with this technique is that positioning the patient's left wrist and arm in a steady and comfortable manner is difficult due to the patient's movement due to discomfort or lack of proper support of the patient's arm. To position the arm, the left arm may be propped up using standard hospital pillows and blankets used for patients' beds. However, the problem with this technique is that pillows and blankets may move around or are not dense enough to properly position the patient's arm and keep it in a steady and comfortable position. The physician or support staff needs to often reposition the pillow and blankets to find a suitable position that is high enough for performing the procedure. For example, the physician may have trouble reaching a morbidly obese patient's wrist due to having to reach over a large abdomen. Even if the physician may reach the patient's wrist, a different position may enable the physician to maintain a more comfortable posture while performing the procedure.

Another problem with this technique is that pillows and blankets may move around or are not dense enough to properly position the patient's arm and keep it in a steady, stationary and comfortable position. The physician may apply some pressure on the arm and wrist during the procedure that may cause the arm and wrist to move or push the arm into the pillows and blankets. Additionally, pillows and blankets do not keep a form that is comfortable for the enough and maintains the arm in a steady and still position for the duration of the procedure and recovery time. The patient may become uncomfortable during the procedure or become fidgety and move their arm, making accessing the left radial artery and engaging the LIMA more difficult or may dislodge the catheter. Pillows and blankets do not provide enough firm shape that maintains the arm's stationary position in a comfortable manner and limits movement.

DETAILED DESCRIPTION

Figure 1:
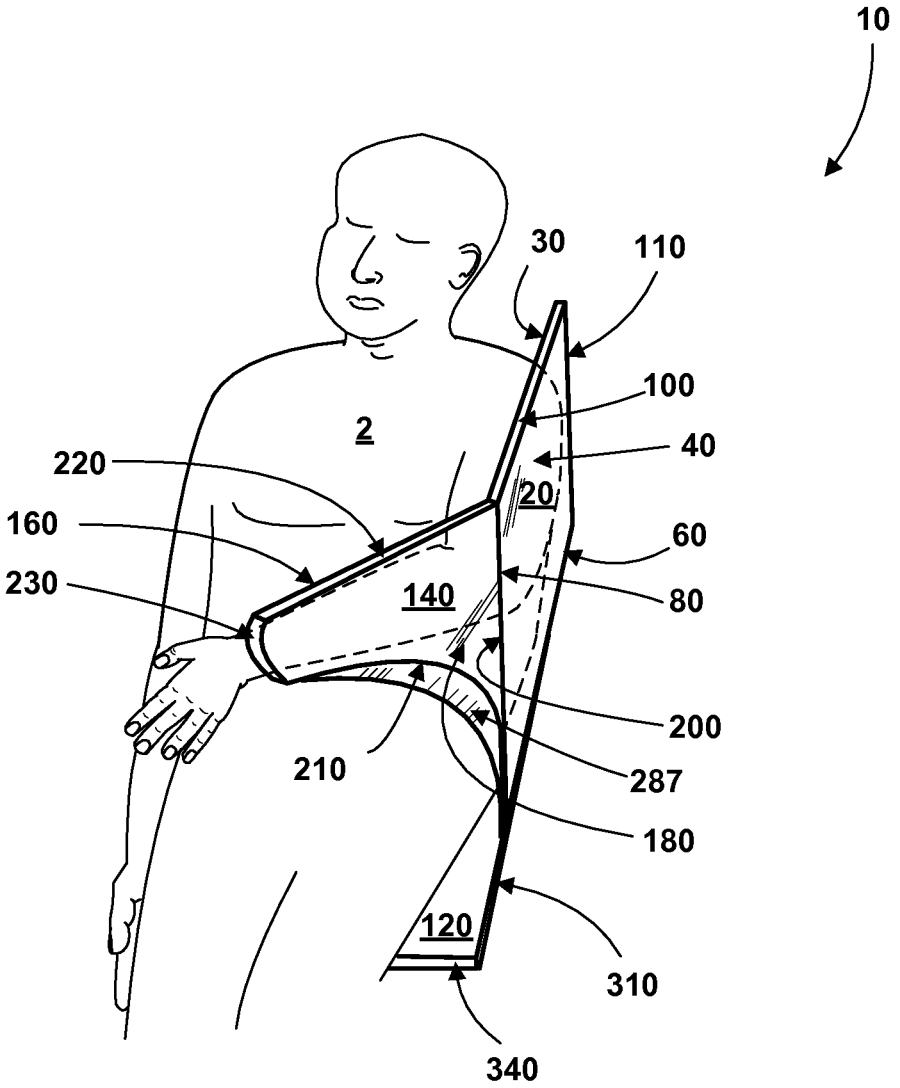
FIG. 1 is a perspective view illustrating an example left arm trans access positioning apparatus that may be used to reduce the movement of the patient's arm during a left transradial approach procedure, in accordance with one or more techniques of the present disclosure.

In general, this disclosure is directed to techniques that may assist a patient's left arm in maintaining a generally immobile position while on an operating table during a left transradial surgical procedure. More particularly, as the patient lies in a supine position, the left forearm maintains a trans access position above the abdomen and may supinate for access to the radial or ulnar arteries. This disclosure is directed to a medical device that limits the movement of the left forearm. During a transradial catheterization, the physician standing on the right side of the patient delicately and precisely works with catheters and wires that may easily dislodge or cause damage to the arterial system if improper movement occurs. Thus, limiting movement of the patient's forearm, may prevent complications during the procedure, and may reduce equipment movement thereby improving patient safety. The left arm trans access positioning bends the elbow so that the patient's wrist is approximately above their femoral artery, but exact positioning depends on the size of the patient. The disclosure of this invention relates to a medical apparatus used to maintain the patient's forearm in a raised and steady position during a left arm trans access surgical procedure. The physician performing the procedure may perform the procedure via either the radial or ulnar arteries.

The left arm trans access positioning board (the "positioning board") maintains the forearm in an elevated trans access position above the plane of the patient's body, for example, by positioning a main panel against the patient's upper arm and a second panel against the patient's forearm when the patient is in the supine position. The arm panels become immobile when a third panel is under the patient.

The weight of the patient's body presses the third panel onto the surgical table, holding it in a stationary position. The stationary third panel becomes the base for immobilizing the positioning board, so that the main panel remains next to the upper arm and the positioning panel remains above and extending over the patient's abdomen. When the patient's forearm is positioned on the positioning board, the forearm becomes immobile so that the patient cannot straighten their arm. The immobile position of the positioning board limits motion of the forearm by a portion of the positioning board placed next to the forearm, allowing forearm rotation towards their head, but not toward their feet. Securing the positioning board to the main panel also limits forearm movement when the physician is performing a transradial catheterization. During the procedure, the physician may apply pressure to the radial side of the patient's wrist without the forearm moving horizontally out of position. The positioning board extends from the main panel to a proximal side, located approximately near the patient's wrist. The proximal side of the positioning board may end just below the patient's wrist, allowing the hand to rotate at the wrist.

The positioning, main and base panels forming the positioning board may be three integrally connected pieces, or formed from one continuous piece. In either case, angles between the panels form the positioning board. For example, the main panel and the extended panel, which extends outward from the main panel, together form an obtuse angle. The obtuse angle receives the elbow creating a bend in the patient's arm between the upper arm and forearm, forming a similar obtuse angle when the forearm lies next to the positioning board that is above the patient and positioned in proximity to the patient's groin. In this position, the physician standing on the patient's right side during the procedure is then closer to the patient's left wrist and does not have to reach across the patient. The exact positioning of the forearm and wrist varies due to the patient's body size and shape.

The positioning board panel conforms to the patient's abdomen. The positioning board has a curved side, which extends between the side attached to the main panel and the proximal side next to the patient's wrist. The curved side is the underside that is next to the patient's abdomen and has a concave recess shaped to receive the patient's abdomen so that the positioning board can extend over the patient's body without the body impeding positioning of the positioning board. In some cases, depending on the size of the patient, the positioning board may rest on the patient's abdomen, providing additional support and limiting the movement of the positioning board during a procedure. The positioning board may position the forearm of the patient higher the abdomen when the dimensions of the over the proximal side of the positioning board may arch over the patient's abdomen, so that the forearm is raised above the abdomen of the patient.

The positioning board may be lined with an elongated piece of malleable material. The material cushions the patient's arm for comfort and supports the arm as the material holds the arm in position. The malleable material may be memory foam or other resilient material that can comfortably support the arm during the procedure and further limit that movement of the arm. The material is an elongated member at the inner surface of the extended panel portion. The elongated member may extend longer to also be at the inner surface of the main panel portion and may extend down far enough to the base panel portion. In this configuration, the elongated member of malleable material may be at the center, or core, of the positioning board. At this position, the elongated member helps to position the forearm by placing the material so that it is under the elbow and forearm may. Additionally, the elongated member may elevate the arm above the abdomen in a better access position for the physician. The malleable material may be formed or may mold around the patients arm, limiting movement.

During a catheterization procedure, imaging is also part of the procedure, allowing visualization of the catheter, wire, stent, etc. placement, and to see blood flow through the cardiovascular system. Thus, the material used to make the positioning board cannot interfere with imaging, for example, computed tomography (CT) scans, x-rays, and fluoroscopy. Materials used to make the positioning board, such as the main, base and extended panel portions may include at least one of radiolucent acrylic material, polycarbonate, or radiolucent plastic material. These materials allow the imaging equipment to image the catheter or equipment placement within the cardiovascular system without significant interference. Similarly, material used to make the elongated member may also not interfere with imaging, such as foam or other plastic or rubber base materials.

Further tethering means may be used to further immobilize the left arm so that the tethers do not obstruct access to the radial artery and do not interfere with equipment used, or obstruct imaging during a transradial catheterization procedure. Additional securing means to secure the positioning board may also be used, for example, an additional panel or piece extending from the main panel, opposite the extended panel, to receive the patient's left shoulder and further prevent horizontal or longitudinal movement of the positioning board. Tethering means may also be used to further secure the positioning board to the patient, for example, or a surgical bed.

The invention will be better understood and its advantages appreciated from the following description. Referring now to the drawings, an embodiment of the positioning board according to the invention is shown in FIGS. 1 through 7.

FIG. 1 is a schematic illustrating an example of a left trans access positioning board for use during surgical medical procedures, such as a positioning board 10 used during a left transradial catheterization, in accordance with one or more aspects of the present disclosure. As shown in FIG. 1, positioning board 10 may be associated with a patient 2 and includes a main panel 20 connected to an extended panel 140. Main panel 20 may have an inner surface 30 and an outer surface 40. Inner surface 30 and outer surface 40 may be opposite to one another. The edges extending between inner surface 30 and outer surface 40 are a first longitudinal side edge 100, a second longitudinal side edge 60 located opposite of first longitudinal side edge 100, a first latitudinal side edge 110 and a second latitudinal side edge 80 located opposite of first latitudinal side edge 110. In one example, main panel 20 may have a generally rectangular shape with four corners, where first latitudinal side edge 110 second latitudinal side edge 80 may extend between opposite ends of first longitudinal side edge 100 and second longitudinal side edge 60. In other examples, second latitudinal side edge 80 may be longer than first latitudinal side edge 110. Second latitudinal side edge 80 may have a length between 5 to 18 inches. Generally, the corners formed where the edges meet may be straight, creating a sharp corner, or rounded, so that inner surface 30 and outer surface 40 have rounded corners or the edges are rounded where they meet inner surface 30 or outer surface 40. Main panel 20 may have other non-rectangular shapes. The upper arm of patient 2 may lie next to inner surface 30 of main panel 20 or may lie next to cushion material lining inner surface 30, for example as illustrated in FIG. 2B.

In one example, second latitudinal side edge 80 of main panel 20 may be adjacent to extended panel 140. Extended panel 140 may have a distal end edge 200, a proximal end edge 230, a top side edge 220 and a bottom side edge 210, and may have an inner surface 160 and an outer surface 180. Distal end edge 200 of extended panel 140 may be adjacent to second latitudinal side edge 80. Generally, extended panel 140 may position the left forearm of patient 2 inward, trans-abdominally. Extended panel 140 may extend generally outward from an upper portion, away from base panel 120, of second latitudinal side 80 of main panel 20. For example, extended panel 140 may form an obtuse angle with main panel 20, so that inner surface 160 of extended panel 140 angles towards a base panel 120. The obtuse angle may receive the left elbow of patient 2, so that upper arm and forearm of patient 2 form a similar obtuse angle when the forearm is next to inner surface 160 of extended panel 140.

In some examples, main panel 20 presses the upper arm in toward the body, particularly at the elbow, causing the forearm to naturally rise over the abdomen. In other examples, bottom side edge 210 of extended panel 140 may have an arcuate shape, at least partially, extending between proximal end edge 230 and said distal end edge 200. The curved shape of bottom side edge 210 creates a concave recess, so that extended panel 140 may receive the left abdominal side of patient 2. The curve shape of bottom edge 210 may extend upward, traversing above at least part of the abdomen, so that proximal end edge 230 is above the lower mid abdomen of patient 2. In this position, a larger abdomen of patient 2 will not substantially interfere with placement of positioning board 10. A greater curve angle of bottom side edge 210 of extended panel 140 may receive a patient that has a larger body mass index or a larger sized abdomen. Additionally, the forearm of patient 2 may extend along extended panel 140, positioning the forearm above the abdomen of patient 2. The curve angle and length of bottom side edge 210 may increase to extend the length of the extended panel 140 in the proximal direction and may increase the height of proximal end edge 230, but relative to increasing the length of top side edge 220.

The obtuse angle of main panel 20 and extended panel 140, and the curved shape of extended panel 140 around the abdomen of patient 2, positions the forearm across the abdomen, so that the hand and wrist of patient 2 extend beyond proximal end edge 230 of extended panel 140, and in proximity to above the right femoral artery. Top side edge 220 may extend to a length so that proximal end edge 230 is next to the forearm of patient 2, and extended panel 140 does not extend next to or beyond the wrist. In this way, the hand can more freely rotate at the wrist, without extended panel 140 limiting or interfering with and rotation. The location of the left hand and wrist in proximity to extended panel 140 may vary due to the length and size of the patient.

Positioning board 10 may also have a base panel 120. Base panel 120 may extend generally outward from second longitudinal side edge 60, and may extend perpendicularly from main panel 20. In some examples, when the patient is in the supine position, base panel 120 is at least partially under the patient's back and above the surgical table. Base panel 120 may extend under the back side of patient 2 in the direction from the left arm to the right arm, extending long enough so that sufficient body weight of patient 2 pushes base panel 120 into the surgical bed to immobilize it.

Figure 2A:
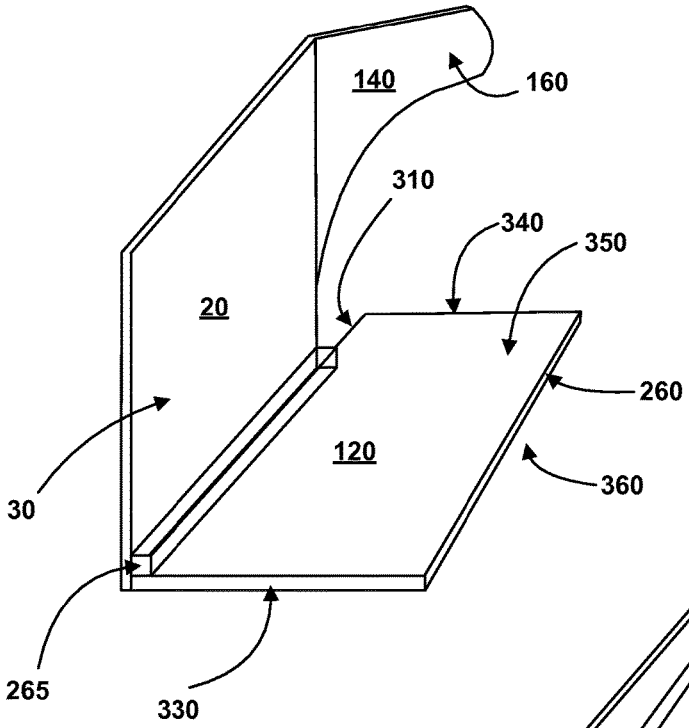
FIGS. 2A-C are illustrations depicting further details of one example of left arm trans access positioning apparatus as shown in FIG. 1, in accordance with one or more techniques of the present disclosure.
Figure 2B:
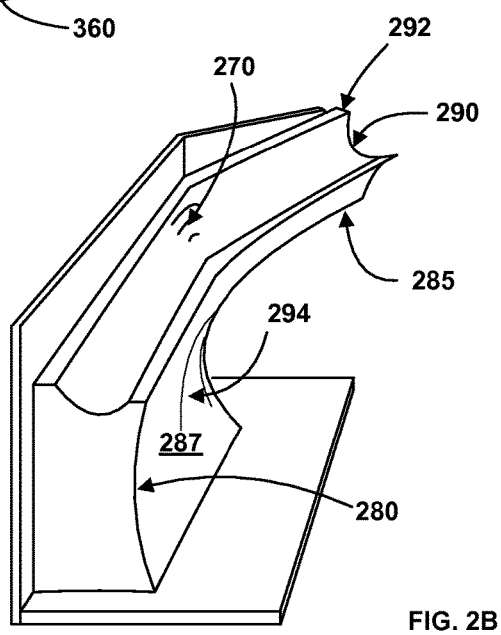

In some examples, as illustrated in FIG. 2A, base panel 120 may comprise a first side edge 330 of base panel 120 and a second side edge 340 that is generally opposite of first side edge 330. Base panel 120 may also have an adjacent side edge 310 and an opposing side edge 260, both extending between first and second side edges 330 and 340. Base panel 120 may also have an upper surface 350 and a lower surface 360 that opposes upper surface 350. When patient 2 lays on a surgical bed in a supine position, upper surface 350 is in proximity to the back of patient 2 and lower surface 360 is in proximity to the surgical bed. The weight of patient 2 presses down on upper surface 350 of base panel 120 and pushes base panel 120 down on the surgical bed, and thus, prevents positioning board 10 from sliding or rotating out of position on the surgical bed. Additionally, because main panel 20 connects to adjacent base panel 120, main panel 20 is also immobilized from the rigid connection. Similarly, the rigid connection to main panel 20 from the weight of patient 2 on base panel 120, also limits the movement of extended panel 140, because extended panel 140 frigidly connects to main panel 20. In other words, the patient's weight on base panel 120 indirectly limits the movement of extended panel 140 via the rigid connections to main panel 20. In some examples, a corner member 265 may attach at inner surface 30 of main panel 20 and upper surface 350 of base panel 120, and may extend at least part of the length of second longitudinal side edge 60. Corner member 265 may reinforce the attachment of main panel 20 to base panel 120.

Adjacent side edge 310 of base panel 120 may be the same length of second longitudinal side edge 60 of main panel 20. For example, adjacent side edge 310 may between 10 to 18 inches in length. In other examples, adjacent side edge 310 of base panel 120 may be longer than second longitudinal side edge 60, so that base panel 120 extends below the buttocks of patient 2. For example, adjacent side edge 310 may be between 13 to 24 inches long. Extending base panel 120 increases the area of upper surface 350 of base panel 120 that receives the force of weight of patient 2, and increasing the surface area of base panel 120 receiving the patient's weight directly increases the immobility of base panel 120. Additionally, extending the length of adjacent side edge 310 beyond the length of longitudinal side edge 60 may fit the body of patient 2 for taller patients, patients with longer torsos or patients with a greater body mass index. To further increase the area, the length of first side edge 330 and second side edge 340 may increase, and may be in a range from 2 inches to 24 inches.

Inner surface 160 of extended panel 140 may be flat or curved shape that is near the forearm. Cushion material may line inner surface 160 and is further discussed in regard to FIG. 2B. Generally, the cushion material may be foam, for example memory foam, or other high resiliency material that is comfortable and forms around the arm when pressure is applied to the material. The material must be resilient and dense enough to create support for the forearm.

FIG. 2B is an example of an elongated member 287 made of cushion material that lines the inner surfaces of positioning board 10 to improve support of the left arm in the trans access position, lifting the elbow and forearm of patient 2 above the abdomen. Elongated member 287 may have recesses to help keep the forearm in a steady position, for example, elongated member 287 is a generally elongated member that extends longitudinally along main panel 20 and extended panel 140.

FIG. 2B elongated member 287 includes a proximal end 290 and a distal end 280. A top edge 292 extends between proximal end 290 and distal end 280. Top edge 292 may have a curved shape to receive the arm of patient 2. The curved shape may have a relatively "U"-shape or a recess extending along top edge 292. Elongated member 287 may have a side edge 294 adjacent to top edge 292. Side edge 294 may have a curved shape, for example a concave shape, for receiving the abdomen of patient 2. Top edge 292 may bend at an obtuse angle, for example at bend 270 as illustrated in FIG. 2B. Bend 270 receives the elbow of patient 2, so that the arm in the recessed portion of top edge 292 bends at the angle of bend 270. The portion of elongated member 287 between bend 270 and proximal end 290 has extension portion 285 where the material extends from side edge 294. Extension material 285 supports the forearm and is under the forearm, extending from side edge 294 to over the abdomen. In another example, the material of elongated member 287 is flexible, so top end 292 does not have bend 270 and is straight, such as in FIG. 5. Elongated member 287 may bend to form 270, as illustrated in FIG. 2B, or may have bend 270 in its form without bending the material, when placed at the inner surfaces of positioning board 10.

The top portion may have a form for receiving an arm of the patient during a transradial approach procedure. The top portion may have at least one groove or recessed portion that may have a depth between 0 in-5 in running between proximal end 290 and distal end 280 of elongated member 287. The depth of the recessed portion of top edge 292 may vary between proximal end 290 and distal end 280. In some examples, proximal end 290 portion may have a different recess depth than distal end 280 portion. To illustrate one of many examples, proximal end 290 may be 2-5 inches deep to accommodate and receive the patient's elbow, but the proximal end 290 has a recess depth of only 0-2 inches to accommodate and receive a more distal portion of the patient's arm, such as the patient's wrist.

Figure 2C:
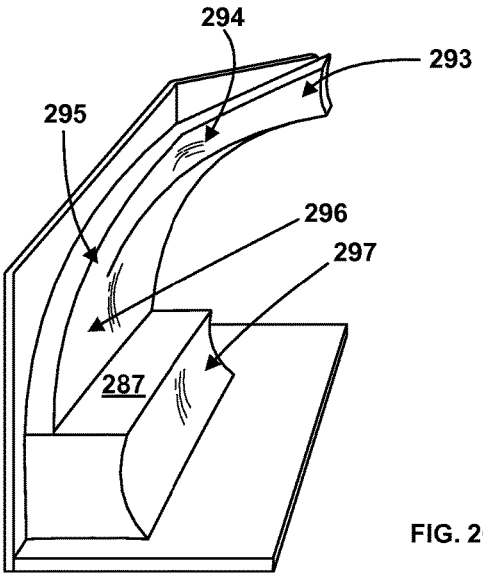

In another example of the form of elongated member 287, FIG. 2C illustrates a lower section 297 for receiving the right side of the patient's abdomen. When the patient assumes the supine position and their left arm assumes the transradial access position, the patient's upper arm, particularly the shoulder, lies next to a middle section 296. However, taller patients may have the upper arm next to middle section 296. The patient's body size and shape varies, and thus, the exact positioning may vary. The patient's upper arm then follows along the form of elongated member 287, so that the upper arm is next to a first recess portion 295, and the elbow is at a second recess portion 294. The form of elongated member 287 may help to support the left arm in a trans axial position, so that as the upper arm angles inward (the wrist moving from the patient's left side towards the right side). The patient's left arm elevates over the left ribs. Second recess portion 294 is at the patient's elbow, further supporting the arm in the elevated position positioning the left upper arm over the left ribs. Second recess portion 294 is a bend point where the material of elongated member 287 curves or bends inward generally towards the patient, in relation to the angle created with extended panel 140 of FIG. 2A and main panel 20. Elongated member 287 continues to a third recess portion 293. In position, that patient's left forearm is at third recess portion 293.

The material of elongated member 287 is dense enough so that it does not collapse or compress while the patient's arm is on elongated member 287 and withstands the weight of the patient's arm and pressure during the procedure. The density is also sufficient so that elongated member 287 does not move due to the patient's arm movement and pressure applied to elongated member 287 during a left transradial catheterization procedure.

Figure 3A:
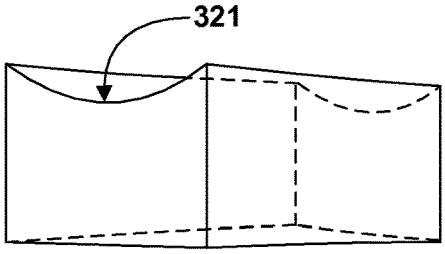
FIGS. 3A-E are illustrations depicting further examples of a left arm trans access positioning apparatus as shown in FIG. 1, in accordance with one or more techniques of the present disclosure.
Figure 3B:
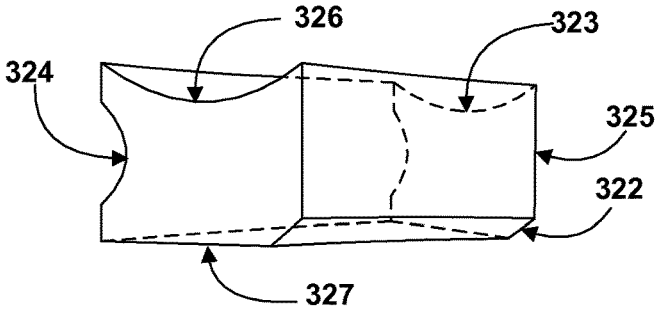

As shown in FIG. 3A illustrates another example of elongated member 287 and a single recessed side 321. FIG. 3B shows a similar recessed side 326 and a top recess 324 that extends along elongated member 287 (as illustrated in FIG. 2B) to create a continuous groove. FIG. 3B also shows an angled portion 322, which allows elongated member 287 to be wedged into position. The elongated member 287 may be inserted into position next to positioning board 10 after positioning board 10 is next to the patient, or elongated member 287 may be attached to positioning board 10.

Figure 3C:
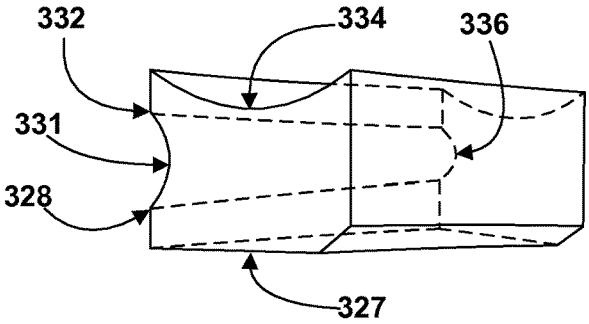

FIG. 3C illustrates the recess or curve of proximal end 331 is wider than the recess or curve of distal end 336. The recess or curved shape extends from proximal end 331 to the distal end 336 creating a narrowing groove extending along elongated member 287.

Figure 3D:
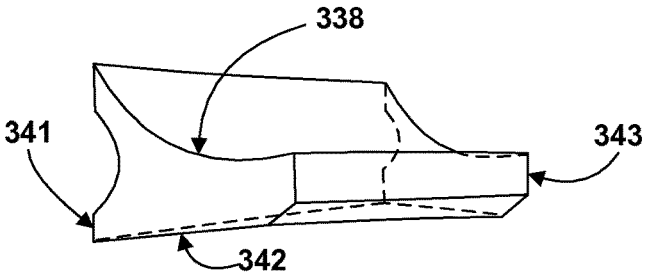

FIG. 3D illustrates another example of elongated member 287 of FIG. 1. Elongated member 287 also has a bottom portion 345 that is narrower than a top edge 341. Bottom portion 343 allows elongated member 287 to fit around a patient that may have a larger mid-section, allowing a wide curve of a side edge 338, or half-U shape, to fit around a large abdomen of patient 2.

Figure 3E:
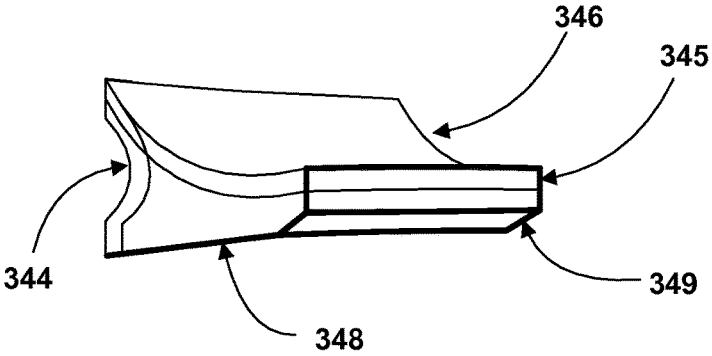

FIG. 3E illustrates different materials used in positioning board 10. A first material for elongated member 287, particularly covering a top recess 344 and a side recess 346. The first material may be malleable to conform to the shape of the patient's body, for example memory foam, and to comfortably cushion the patient's arm. The first malleable material may further improve stability by conforming to the patient's body, and thus, limiting motion of the patient's arm. A second different material on an outer side portion 348 of elongated member 287, may be sufficiently ridged so that it does not compress or bend when pressure is applied to outer side portion 348.

FIG. 3E further shows a second material covering the outside of at least one exterior portion such as the side portion, the bottom portion, or the angled portion. The second material seals the exterior sides of elongated member 287. The second material may improve sterility of elongated member 287 by sealing elongated member 287 off one or more of the exterior portions with a barrier that prevents moisture, bacteria, etc. from getting in the denser material of the elongated member and the cushion material.

Figure 4:
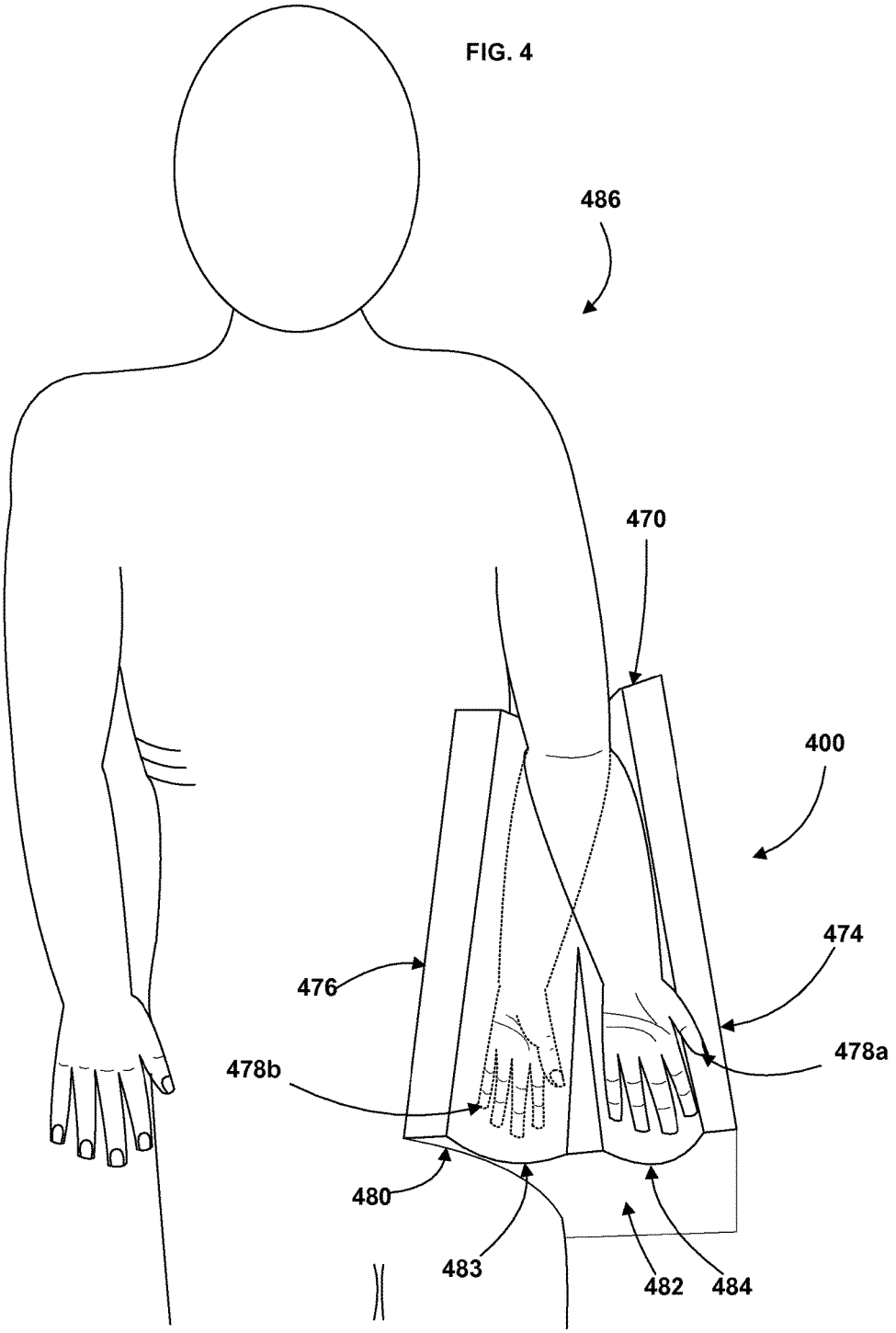
FIG. 4 is a perspective view illustrating further details of a left arm trans access positioning apparatus as shown in FIG. 1, in accordance with one or more techniques of the present disclosure.
Figure 5:
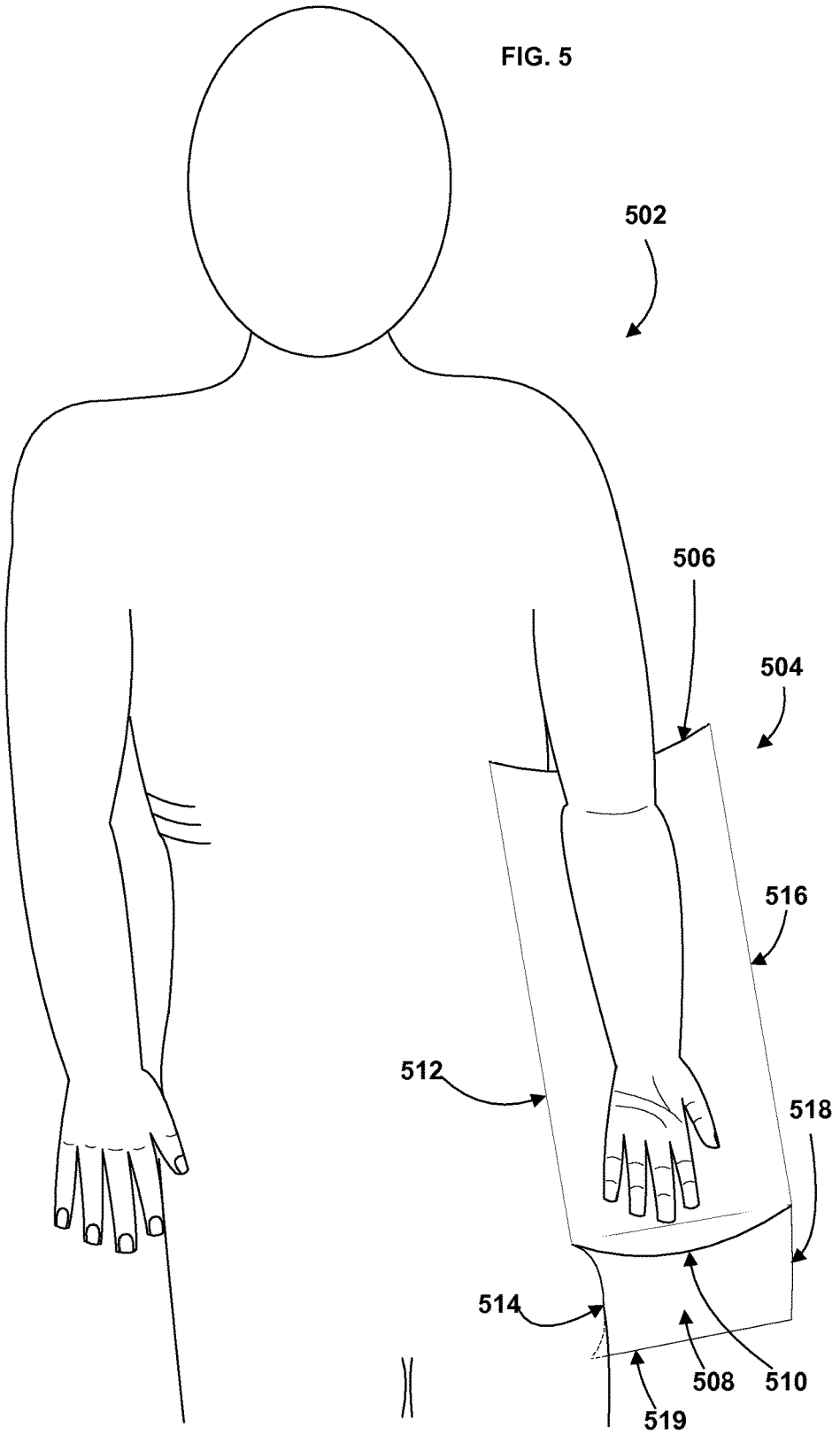
FIG. 5 is an illustration showing further details of a left arm trans access positioning apparatus as shown in FIG. 1, in accordance with one or more techniques of the present disclosure.

FIG. 4 illustrates a first position 478*a* and a second position 478*b* of the arm on elongated member 287. First position 478*a* has the arm along the patient's left side. FIG. 5 is an example of first position 478*a*. Second position 478*b* is located higher and next to the curved portion 480 of elongated member 287. The higher position of the second position 478*b* is due to curved portion 480 being longer on distal end 482. The longer raised curved portion 480 helps to position the hand in second position 78*b*, so that it is elevated and positioned closer to the center of the patient's body and extending over the abdomen of the patient. In some examples, a second top portion 476, being over curved portion 480, may be longer than a first top portion 474, so that the corner of second top portion 476 and curved portion 80 meet at a point that would be over the patient's abdomen. The configuration of elongated member 287 with respect to main panel 20 may change from, for example, first position 478*a* to second position 478*b* because may have an adjustable positioning means for extended panel 140 (as illustrated in FIG. 1). First position 478*a* may be between 30 to 80 degrees different from second position 478*b*.

Extended panel 140 may be a removable piece may attach to base panel 120 using, as one example, a pin-in-hole means. In other examples, the removable piece may move into place using a spring means. The spring may push the second piece that would raise the patient's arm and angle the arm inward (angled from the proximal end or pivoting joint such as an elbow or shoulder), positioning it over the body of the patient. The pressure from the spring in an extended position may hold the patient's arm in a raised position over the abdomen by applying pressure to the second extended piece when the spring extends. Other securing means are possible such that the removable piece is securely attached to the elongated member and limits movement of the removable piece while it is attached.

In other examples, main panel 20 (illustrated in FIG.1) may also be moveable independent from base panel 120. Main panel 20 may be attached to base panel 120 by groove means, so that main panel 20 may slide along the groove to accommodate different body shapes so that positioning board 10 better accommodates the patient's size. Other means for attaching main panel 20 to base panel 120 may include pin-in-hole or spring means.

Figure 6A:
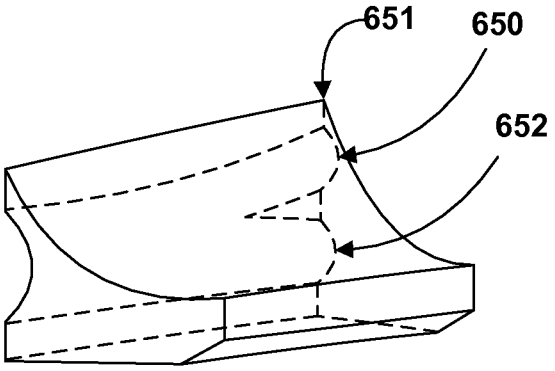
FIGS. 6A-B are illustrations depicting further details of one example of a left arm trans access positioning apparatus as shown in FIG. 1, in accordance with one or more techniques of the present disclosure.
Figure 6B:
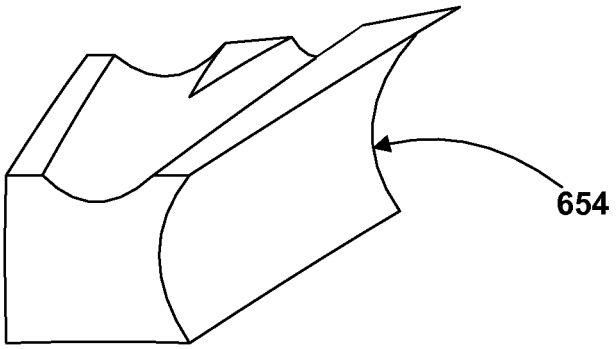

FIG. 6A and FIG. 6B illustrate another example of a form of elongated member 287, such as the one illustrated in FIG. 4. The patient's forearm may be at a first recess 652 when the arm is straight, but when the arm moves to a second recess 650, then the patient's arm is in the trans access position. Side recess potion 654 is at the abdomen of the patient in both positions.

Figure 7:
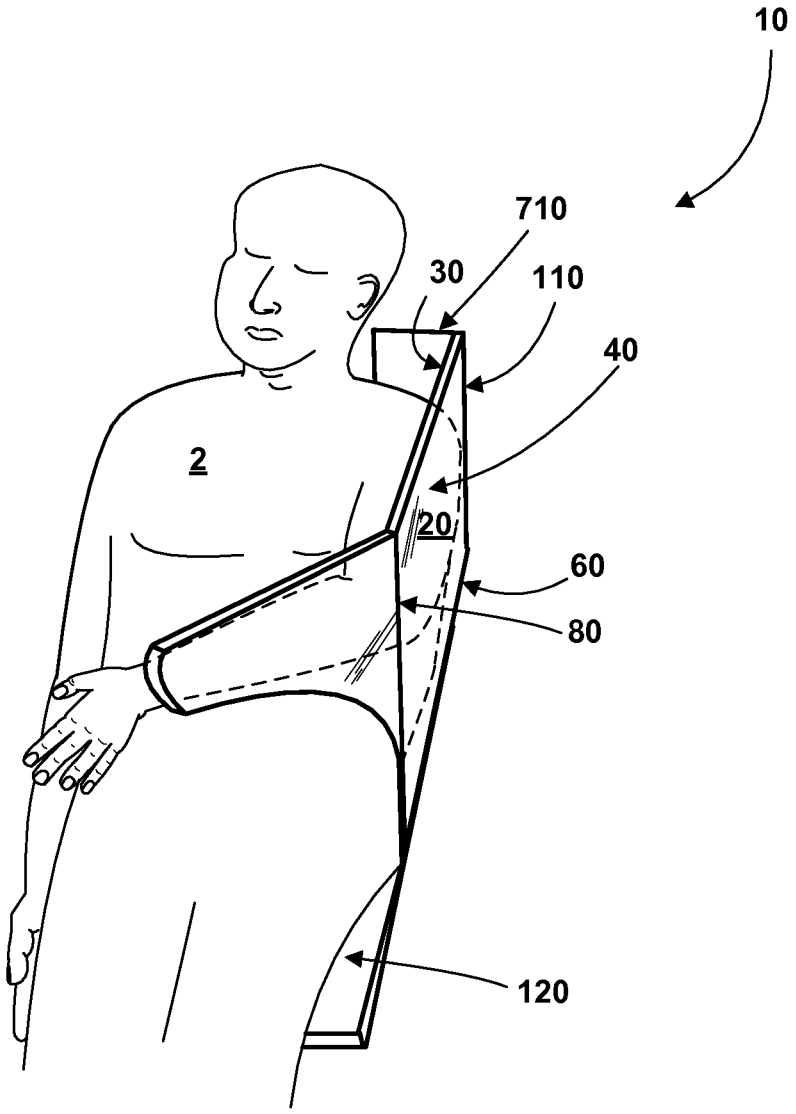
FIG. 7 is an illustration showing further details of one example of a left arm trans access positioning apparatus as shown in FIG. 1, illustrating a fourth extended portion.

In another example, FIG. 7 illustrates a fourth panel 710 that is adjacent to a first latitudinal side edge 110 of main panel 20. Fourth panel 710 receives the patient's left shoulder for limiting longitudinal movement of the apparatus towards that patient's feet. Fourth panel 710 further secures that positioning board 10 in place. However, tethering means could also further limit the motion of positioning board 10 by securing main panel 20 or base panel 120 to, for example, the surgical bed or the patient.

The disclosure relates to an apparatus for positioning a patient's forearm during a medical procedure comprising a main panel portion having an inner surface and an outer surface, a first longitudinal side edge, a second longitudinal side edge, a first latitudinal side edge and a second latitudinal side edge. The apparatus may also comprise an extended panel portion having a proximal end edge and a distal end edge, and an inner surface, wherein said distal end edge forms an angled configuration with said main panel portion for positioning the patient's left forearm and wrist suitably for receiving an arterial catheter, and a base panel portion having a first longitudinal side edge and a second longitudinal side edge, said first longitudinal side edge of said base panel portion extending generally perpendicularly outward from said second longitudinal side edge of said main panel portion. The extended panel portion further has a bottom surface, a top edge and a bottom edge. The bottom edge of said extended panel portion has an at least partially curved shape extending between said distal end edge and said proximal end edge, the curved shape is a recess for receiving the patient's abdomen. The arch of said bottom edge of extended panel portion extends over the patient's abdomen while patient is lying in the supine position, sufficiently positioning the patient's wrist above or in proximity to the patient's sacrum. The proximal end edge ends at the patient's forearm below the wrist.

The base panel portion of the apparatus may further have an upper surface to support the back of the patient lying in a supine position. The adjacent side edge of the base panel may be longer than said second longitudinal side edge of the main panel portion.

The angled configuration formed with said main panel portion and said extended panel portion is within a range of 90 to 165 degrees. The extended panel portion has an inner surface, wherein said inner surface has cushioning to comfortably support the patient's forearm. The inner surface is next to an elongated core member made of malleable material. The elongated core member is a support with a top surface and a trough portion along the top surface for positioning the patient's forearm in said trough portion. The extended portion may have restraining means for restraining the patient's forearm in a supinated position suitable for receiving an arterial catheter.

The main, base and extended panel portions are formed of at least one of radiolucent acrylic material, radiolucent polycarbonate or radiolucent plastic material. The main, base and extended panel portions are formed integrally as a one piece positioning board.

The extended panel portion is configured to move from a first position to a second position, wherein the first position is configured to position the patient's left arm next to the patient's left side and the second position is configured to position the patient's left forearm in a trans access position.

The apparatus for positioning a patient's forearm during a medical procedure may further comprise a fourth panel, wherein said fourth panel is adjacent to said first latitudinal side edge of the main panel portion and receives the patient's left shoulder for limiting longitudinal motion of the apparatus.

The disclosure may also relate to a method for positioning a patient's forearm during a medical procedure comprising providing a main panel portion having an inner surface and an outer surface, a first longitudinal side edge, a second longitudinal side edge, a first latitudinal side edge and a second latitudinal side edge. The method may further comprise providing an extended panel portion having a proximal end edge and a distal end edge, and an inner surface, wherein said distal end edge forms an angled configuration with said main panel portion, and positioning the patient's forearm on said extended panel portion to position the patient's left forearm and wrist suitable for receiving an arterial catheter.

The extended panel portion further has a top edge and a bottom edge, said bottom edge of said extended panel portion has an at least partially curved shape extending between said distal end edge and said proximal end edge, wherein the method further comprises positioning the abdomen of the patient at least partially in said at least partially curved shape of said bottom edge. The extended panel portion has an inner surface, further comprising providing cushioning at the inner surface of the extended panel portion to comfortably support the patient's forearm. The inner surface may be next to an elongated core member made of malleable material for support, further comprising positioning the patient's forearm material at least partially in a trough portion along a top surface of the elongated core member.

The invention has been described by reference to detailed examples and methodologies. These examples are not meant to limit the scope of the invention. Variations within the concepts of the invention are apparent to those skilled in the art. The disclosures of the cited references throughout the application are incorporated by reference herein. Various examples have been described. These and other examples are within the scope of the following claims.

The invention claimed is:

1. An apparatus for positioning a patient's forearm during a medical procedure comprising:

a main panel having a first longitudinal edge, a second longitudinal edge, and a latitudinal edge extending between said first and second longitudinal edges, wherein said main panel is configured to abut an upper arm of the patient while the patient is in a generally supine position for the medical procedure an extended panel having a proximal end, a distal end, and a bottom side, which extends in a curve between the proximal end and the distal end, wherein the curve arches from the latitudinal edge of the main panel proximate the base panel and along the bottom side to the proximal end, forming a recess for receiving an abdomen of the patient in said curve of the bottom side, further wherein said extended panel extends, at the distal end, outward from said latitudinal edge of the main panel, forming an obtuse angle configuration with said main panel for receiving and maintaining the angle of the elbow of the patient and positioning a patient's left forearm on the extended panel and for positioning a patient's wrist at the sacrum on the anterior side of the patient suitably for receiving an arterial catheter transradially; and a base panel extending perpendicularly outward from said second longitudinal edge of said main panel.

2. The extended panel of claim 1, wherein said bottom side of said extended panel has an at least partially curved shape extending between said distal end and said proximal end.

3. The apparatus for positioning a patient's forearm during a medical procedure of claim 1, wherein the base panel further has an upper surface for positioning under the abdomen of the patient lying in the supine position.

4. The apparatus for positioning a patient's forearm during a medical procedure of claim 1, wherein an adjacent side of the base panel extends between a first base side and a second base side and is longer than said second longitudinal edge of the main panel.

5. The apparatus for positioning a patient's forearm during a medical procedure of claim 1, wherein the angled configuration formed with said main panel and said extended panel is within a range of 90 to 165 degrees.

6. The apparatus for positioning a patient's forearm during the medical procedure of claim 1, wherein the extended panel has an inner surface, said inner surface has cushioning to comfortably support the patient's forearm.

7. The extended panel of claim 1, further having an inner and outer surface, wherein the inner surface being adjacent to an elongated core member made of malleable material, said elongated core member being a lifting arm support with a top surface and a trough along the top surface for positioning the patient's forearm in said trough.

8. The extended panel of claim 1, wherein the proximal end is narrower than the distal end.

9. The apparatus for positioning the patient's forearm during a medical procedure of claim 1, wherein the extended may have movement limiting material for restraining the patient's forearm in a supinated position suitable for receiving an arterial catheter.

10. The apparatus for positioning the patient's forearm during a medical procedure of claim 1, wherein the main, base and extended panels are formed of at least one of radiolucent acrylic material, radiolucent polycarbonate or radiolucent plastic material.

11. The apparatus for positioning the patient's forearm during the medical procedure of claim 1, wherein said main, base and extended panels are an integrally formed one-piece positioning board.

12. The apparatus for positioning the patient's forearm during the medical procedure of claim 1, wherein the curve arching from a bottom side of extended panel extends outward from the latitudinal edge for suitably positioning the patient's wrist near the patient's navel for receiving an arterial catheter transradially from a physician on the side of the patient opposite the apparatus.

13. The apparatus for positioning a patient's forearm during the medical procedure of claim 1, wherein the extended panel is configured to move from a first position to a second position, wherein the first position is configured to position the patient's left arm next to the patient's left side and the second position is configured to position the patient's forearm in a trans access position at the patient's sacrum.

14. The apparatus for positioning a patient's forearm during the medical procedure of claim 1, further comprises a fourth panel, wherein said fourth panel is adjacent to said first latitudinal side edge of the main panel and receives the patient's left shoulder for limiting longitudinal motion of the apparatus.

15. A method for positioning a patient's forearm with an apparatus during a medical procedure comprising:

providing a main panel having a first longitudinal edge, a second longitudinal edge, and a latitudinal edge extending between said first and second longitudinal edges, wherein said main panel is configured to abut butting an upper arm of the patient is in a generally supine position for the medical procedure providing an extended panel having a proximal end, a distal end, and a bottom side, which extends in a curve between the proximal end and the distal end, wherein the curve arches from the latitudinal edge of the main panel proximate the base panel and along the bottom side to the proximal end, forming a recess for receiving an abdomen of the patient in said curve of the bottom side, further wherein said extended panel extends, at the distal end, outward from said latitudinal edge of the main, forming an obtuse angle configuration with said main panel for receiving a bent elbow of the patient and positioning a patient's left forearm on the extended panel and for positioning a patient's wrist near the navel of the patient suitably for transradial arterial access;

providing a base panel having a base panel first side and a base panel second side, said first longitudinal side of said base panel extending perpendicularly outward from said second longitudinal edge of said main panel; and positioning the patient's forearm on said extended panel to position the patient's wrist at the patient's sacrum suitable for receiving an arterial catheter transradially.

16. The method for using an apparatus for positioning a patient's forearm during a medical procedure of claim 15, wherein the bottom side of said extended panel has an at least partially curved shape extending between said distal end and said proximal end, wherein the method further comprises positioning said at least partially curved shape of said bottom side on the abdomen of the patient for receiving an arterial catheter transradially from a physician at the side of the patient opposite the apparatus.

17. The method for using an apparatus for positioning a patient's forearm during a medical procedure of claim 15, the extended panel has an inner surface, further comprising providing cushioning at the inner surface to comfortably support the patient's forearm.

18. The method of claim 15, wherein at least the extended panel further includes an elongated core member between the patient and the apparatus, wherein the elongated core member is made of malleable material for supporting the forearm, the method further comprising positioning the patient's forearm on the malleable material at least partially on the elongated core member.

* * * * *